United States Patent [19]

Nolin

[11] 4,011,741

[45] Mar. 15, 1977

[54] LOCK CYLINDER WITH DUAL DRIVERS

[75] Inventor: Roger J. Nolin, Monterey Park, Calif.

[73] Assignee: TRE Corporation, Beverly Hills, Calif.

[22] Filed: Apr. 6, 1976

[21] Appl. No.: 674,228

[52] U.S. Cl. ..... 70/107; 70/462; 70/DIG. 42; 292/34; 292/35

[51] Int. Cl.[2] ..... E05B 63/14

[58] Field of Search ..... 70/149, 156, 379 R, 70/388, DIG. 80, 462, 107, DIG. 42; 292/34, 36, 37, 48, 165, 167, 336.3

[56] References Cited

UNITED STATES PATENTS

| | | | |
|---|---|---|---|
| 1,528,515 | 3/1925 | Taylor | 70/149 X |
| 3,791,180 | 2/1974 | Doyle | 70/107 |
| 3,910,613 | 10/1975 | Nolin | 70/107 X |
| 3,933,016 | 1/1976 | Nolin | 70/149 |

FOREIGN PATENTS OR APPLICATIONS

| | | | |
|---|---|---|---|
| 834,448 | 2/1970 | Canada | 70/107 |

*Primary Examiner*—J. Franklin Foss
*Attorney, Agent, or Firm*—Blakely, Sokoloff, Taylor & Zafman

[57] ABSTRACT

A lock cylinder with dual driver whereby an independent drive for the dead bolt mechanism and the door latch mechanism may be achieved with a single lock so as to provide withdrawal of both the latch bolt and the dead bolt by rotation of the key inserted into the lock cylinder. The drive for the dead bolt actuating mechanism is a conventional lost motion drive extending from the rear of the cylinder assembly. In addition, a cam is coupled to the cylinder assembly threaded cap so as to provide a direct drive thereto, with a cam being coupled to the latch mechanism so that both the dead bolt and the latch bolt are retracted upon rotation of a key in the lock.

14 Claims, 13 Drawing Figures

Fig. 4
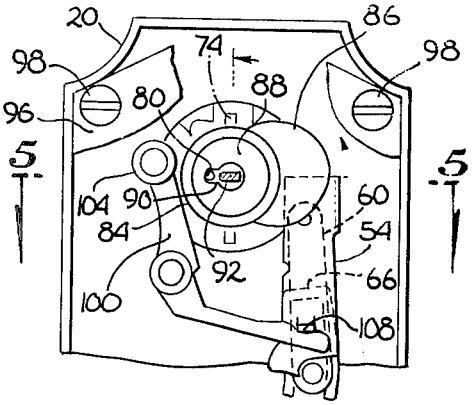
Fig. 5
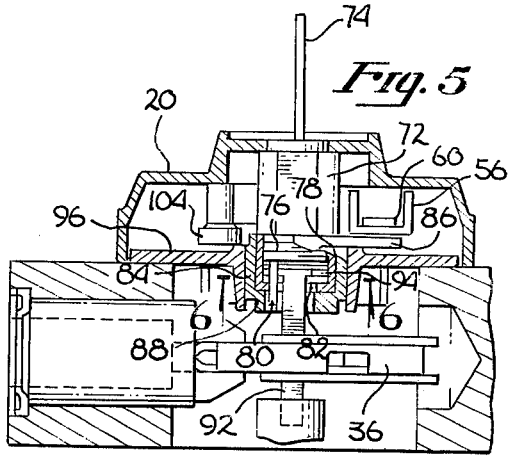
Fig. 7
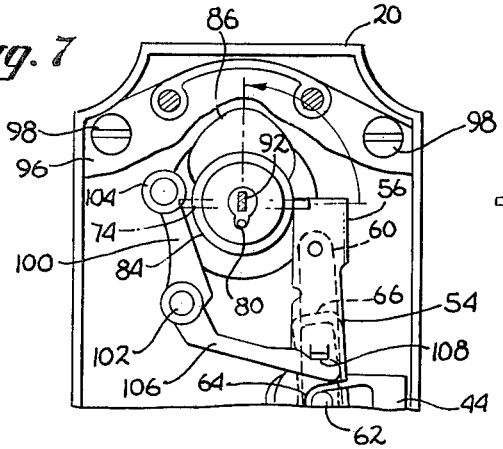
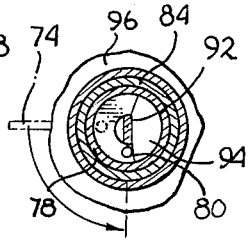
Fig. 8
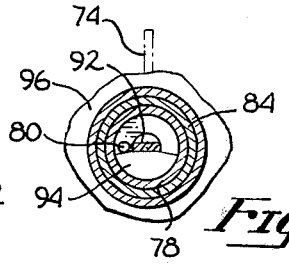
Fig. 6
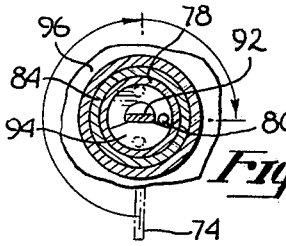
Fig. 11
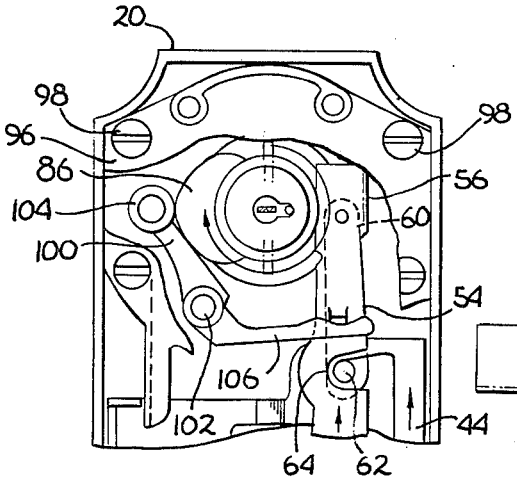
Fig. 10
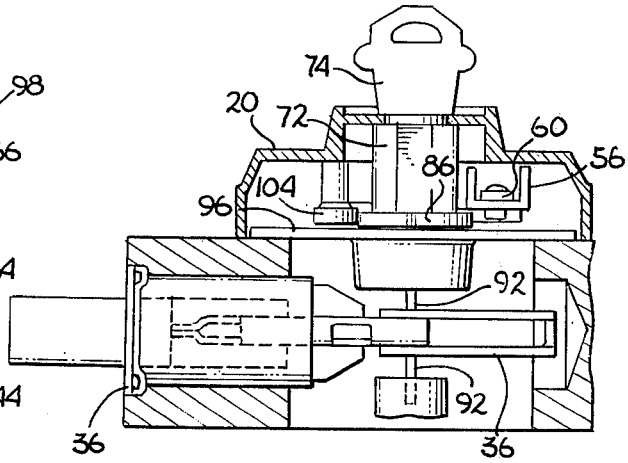
Fig. 9

LOCK CYLINDER WITH DUAL DRIVERS

BACKGROUND OF THE INVENTION

1. Field of the Invention

The present invention relates to the field of door latch and lock mechanisms.

2. Prior Art

Historically, latch bolt mechanisms and dead bolt mechanisms are individual and separate mechanisms, with the latch bolt mechanisms frequently including its own lock. Accordingly, two keys (or alternatively, one key fitting both locks) are required to unlock both the latch mechanism and to withdraw the dead bolt. In the dead bolt mechanism itself, the typical cylinder assembly includes what is commonly referred to as a lost motion drive, which couples the key rotation to the bolt withdrawing mechanism. In particular, a dead bolt is extended or withdrawn by inserting the key into the key slot in the cylinder assembly, rotating the key approximately one hundred eighty degrees toward the locked or the unlocked position as desired, returning the key to the initial position so that the pins and tumblers are again aligned, and then withdrawing the key. Since the key may only be withdrawn when the tumblers and pins are aligned, it is necessary that rotation of the key back to the initial position to allow removal thereof does not undo the effect of the previous key rotation, whether to retract or extend the dead bolt.

To provide the lost motion drive required, the dead bolt mechanism itself is generally driven by a tail piece having approximately 180° of angular freedom with respect to the threaded cap and plug of the cylinder assembly. Accordingly, to extend the latch bolt the key may be inserted and rotated approximately 180° toward the locked position, with the subsequent return to the initial position of the key being decoupled from the latch bolt mechanism. However, on rotation of the key in the opposite direction, immediate drive will be provided to retract the dead bolt, since the mechanism is then at the limit of its lost motion.

One common form of lost motion drive on a cylinder assembly utilizes a key receiving member (e.g., the member containing the tumblers) having the rear or tail section thereof threaded to receive a threaded cap at the inner end of the cylinder assembly. Utilizing threads for this connection allows adjusting the axial position of the threaded cap screwed over the threaded region so as to minimize end play in the assembly, with the threaded cap being retained in position by a spring loaded pin. Retained under the threaded cap is a segment member coupled to a tail piece member, with the segment member occupying an angle of slightly less than 180° and being driven by the pin retaining the threaded cap. It is the combination of the segment member and pin which provides the desired lost motion, with the segment member itself determining the extent of lost motion provided.

In addition to the foregoing, direct drives from the plug and threaded cap have been utilized in prior art locks. By way of example, the Door Lock Mechanism of U.S. Pat. No. 3,933,016, issued Jan. 20, 1976 to Roger J. Nolin and assigned to the assignee of the present invention discloses a latch assembly including a lock having a cylinder assembly driving the mechanism through a gear coupled directly to the plug. Thus, in that assembly, no lost motion of the drive is provided.

BRIEF SUMMARY OF THE INVENTION

A lock cylinder with dual driver whereby an independent drive for the dead bolt mechanism and the door latch mechanism may be achieved with a single lock so as to provide withdrawal of both the latch bolt and the dead bolt by rotation of the key inserted into the lock cylinder. The drive for the dead bolt actuating mechanism is a conventional lost motion drive extending from the rear of the cylinder assembly. In addition, a cam is coupled to the cylinder assembly threaded cap so as to provide a direct drive thereto, with a cam being coupled to the latch mechanism so that both the dead bolt and the latch bolt are retracted upon rotation of a key in the lock. Separate drives for the dead bolt and latch bolt allows retraction of the dead bolt faster than the latch bolt, tending to avoid binding of the latch bolt sometimes encountered with other mechanisms. Two embodiments are disclosed in detail; one wherein the cam is captured and retained with respect to the cylinder assembly, and one wherein the cam is a slip-fit to the cylinder assembly and retained by additional structure resulting from the further assembly of the latch and lock mechanism.

BRIEF DESCRIPTION OF THE DRAWINGS

FIGS. 4, 7 and 10 are views looking at a portion of a back of the outer escutcheon illustrating the operation of the present invention.

FIGS. 5 and 9 are partial cross sections of the assembly of FIG. 1 illustrating the coupling of the cylinder and dead bolt assemblies.

FIGS. 6, 8 and 11 are cross sections taken through the tailpiece adjacent the inner end of the plug illustrating the operation of the lost motion drive.

DETAILED DESCRIPTION OF THE INVENTION

Figure 1:
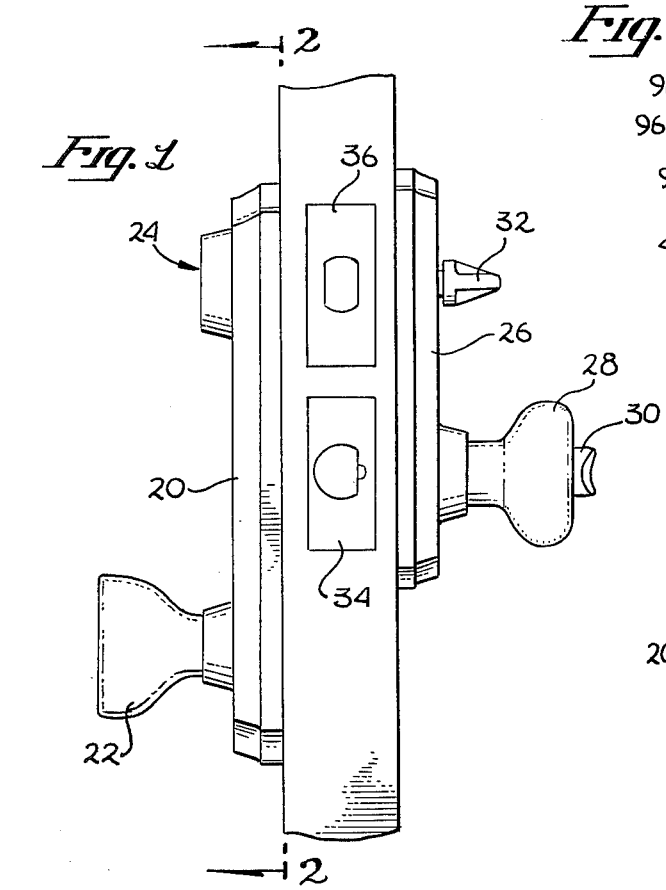
FIG. 1 is a view of the edge of a door illustrating the mounting of the present invention thereto.

First referring to FIG. 1, an edge view of a door with the present invention lock mechanism thereon may be seen. This particular embodiment is characterized by an outer escutcheon 20 supporting a knob 22 and housing a key lock assembly generally indicated by the numeral 24, and an interior escutcheon 26 supporting the inner knob 28 with coaxial lock knob 30 and a manual dead bolt actuator 32. This particular mechanism utilizes a standard latch bolt assembly 34 and a standard dead bolt assembly 36, though it is the mechanism drive which allows the dual operation of the latch bolt and dead bolt by the single key lock which forms the present invention. In particular, as shall subsequently be seen in detail, the single key lock not only may withdraw both the latch bolt and dead bolt, but may do so through a dual drive mechanism which allows, among other things, the independent and more rapid withdrawal of the dead bolt so as to avoid any problem of dead bolt jamming sometimes encountered whenever the latch bolt is first released.

In order to best illustrate the present invention and its cooperation with other operative parts of the dead bolt and latch bolt mechanism, other parts of the assembly will first be described. In particular in FIG. 2, a view, partially cut away, looking into the back of the outer escutcheon 20 along line 2—2 of FIG. 1 may be seen. The particular assembly shown in this and the other figures of this disclosure is an assembly of an embodiment featuring a disengagable exterior knob. Thus, when the latch bolt mechanism is locked the outer knob 22 is free to rotate through a full 360° without damage or detriment to any of the internal parts. This aspect of the assembly is shown for purposes of clarity only, to illustrate the specific environment in which the present invention is utilized, and standing alone forms no part of the present invention. It is to be understood, however, that the present invention may readily be used with other types of assemblies such as, by way of example, a thumb latch actuator type door lock mechanism, such as that shown in U.S. Pat. No. 3,933,016. Further, since the mechanism of the present invention is in general contained within the outer escutcheon, other features may also be incorporated with the present invention such as by way of example, the panic-proof feature of U.S. Pat. No. 3,910,613, entitled "Panic Proof Lock Set" issued to Roger J. Nolin and assigned on its face to the same assignee as the present invention.

Figure 2:
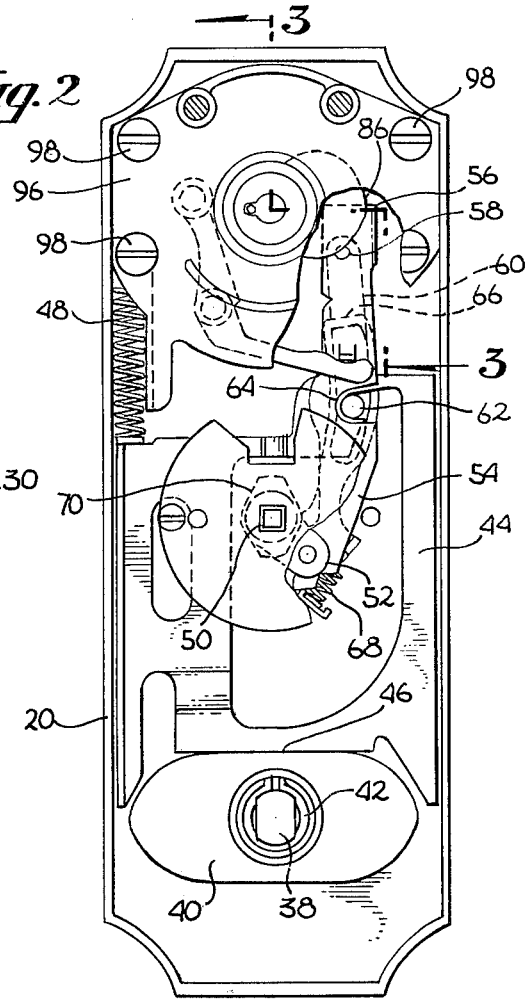
FIG. 2 is a view looking into the back of the outer escutcheon taken along line 2—2 of FIG. 1.

As may be seen from FIGS. 1 and 2, knob 22, coupled to shaft 38, drives a cam 40 within the outer escutcheon, being retained with respect thereto by a snap ring 42. A slide plate 44, having a cam follower surface 46, is disposed within the outer escutcheon and yieldably encouraged to the lower position shown in FIG. 2 by a coil spring 48. Accordingly, on rotation of the outer knob 22, slide plate 44 will be encouraged upward against the coil spring 48. The latch bolt assembly 34 is of conventional construction, being driven in rotation by a square shaft 50 coupled to an actuating lever 52 rotationally coupled at its outer end to a connecting member 54 extending upward therefrom, with its upper end 56 having the sides thereof bent over for sliding contact with the surface of the escutcheon. Pivotally coupled to the connecting member 54 by a rivet 58 is a downward extending arm 60, shown in phantom in FIG. 2, supporting a pin 62 projecting through both sides of the arm 60. The upper end of pin 62, as shown, engages a cooperatively disposed slot 64 in the slide plate 44, though it may be rotated to a position not engaging the slot by a shifting lever 66, also shown in phantom in FIG. 2 and engaging the lower end of pin 62. More particularly, the shifting lever 66 is spring loaded by way of a spring 68 into the position shown, though may be shifted substantially to the right to disengage pin 62 with the slot 64 in the slide plate 44 by rotation of a cam 70, operable by the thumb knob 30 (see FIG. 1). Accordingly, when the assembly is in the position shown in FIG. 2, rotation of the exterior knob 22 will cause the slide plate 44 to move upward, carrying with it pin 62 and members 60 and 54, thereby lifting the lever 52 to rotate shaft 50 and retract the latch bolt. However, when thumb knob 30 is rotated 90°, cam 70 rotates, forcing the shifting member 66 to the right and disengaging the pin 62 from the slot in the slide plate 44, thereby allowing the slide plate 44 to vertically reciprocate and allowing free rotation of the outer knob without unlatching the door.

Figure 3:
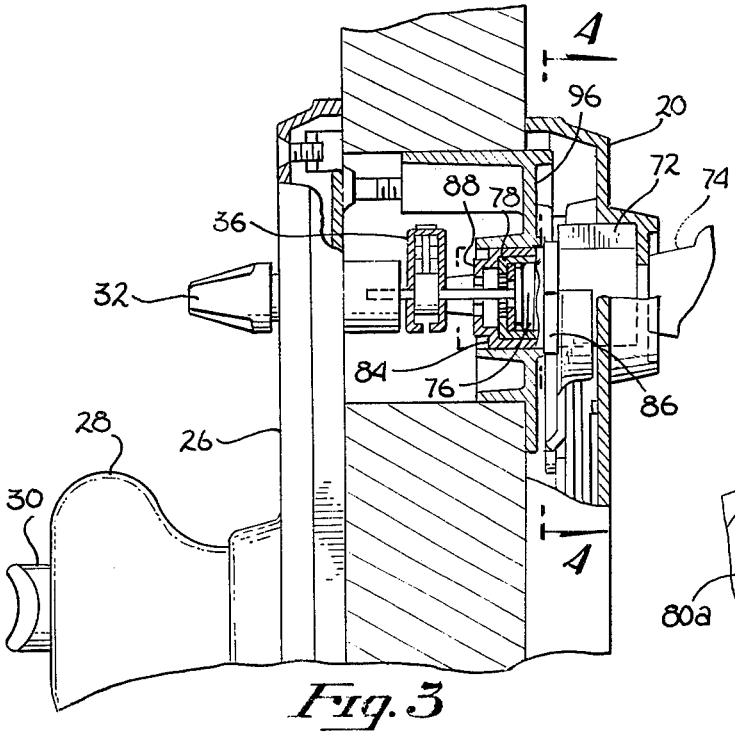
FIG. 3 is a partial cross section taken along line 3—3 of FIG. 2.

Now referring to FIGS. 3, 4 and 5, details of the specific structure of one embodiment of the present invention may be seen. Housed within the outer escutcheon 20 is a conventional cylinder assembly 72 comprised of an outer cylinder containing a plurality of spring loaded pins, and a central plug containing a plurality of tumblers and having a slot extending through the outer face thereof to receive a key 74. The inner end 76 of the plug is threaded so as to receive a threaded cap 78, threaded onto the plug to a position to minimize end-play between the plug and the cylinder and retained in that position by a spring-loaded stepped pin 80 engaging the scalloped inner periphery 82 of the outer end of the threaded cap. In the particular embodiment disclosed herein, the key slot in the plug extends entirely through the plug, a feature which is utilized to advantage in another embodiment of the invention to be described herein.

Slipping over the threaded cap 78 is an approximately cylindrical member 84 supporting a cam 86. The profile of cam 86 is best illustrated in FIG. 4, with the relative elevation of the cam being best illustrated in FIGS. 3 and 5. In the preferred embodiment, the cam is essentially adjacent the end of the cylinder so as to be freely rotatable with respect to the pin housing portion of the cylinder. The cylindrical member 84, on which the cam 86 is an integral part, has an inward directed face 88 at the end thereof with the slot 90 being picked up by an extension of pin 80. Therefore, the cam member is radially supported on the threaded cap, which in turn is supported on the end of the plug projecting through the cylinder, with the cam member being driven in rotation by the plug as a result of the engagement of the pin 80 with the slot 90 in the cam.

A dead bolt drive member or tail piece 92 is coupled to a sector member 94 (see also FIG. 8) which is retained under the threaded cap 78 and driven in rotation by the spring loaded pin 80. The segment member 94 in the preferred embodiment occupies an angular segment of somewhat less than 180° so that the segment member in cooperation with the pin 80 provides approximately 180° of lost motion. Accordingly, after driving the segment member in one direction by rotation of the plug in that direction, the plug must be rotated approximately 180° before pin 80 picks up the other side of the segment member and starts driving the segment member and tail piece member 92 in the opposite direction. Accordingly this assembly provides a first drive means coupled to the plug and having a substantial lost motion in the drive of the dead bolt. The purpose of this lost motion is to allow rotation of a key to lock the dead bolt followed by rotation back to the initial position to allow withdrawing of the key without unlocking the dead bolt, and similarly the unlocking of the dead bolt and rotation of the key back to the position for withdrawal of the key without relocking of the bolt.

While the cam 86 merely slides over the end of the threaded cap, it is retained in position in the assembly by entrapment between the cylinder assembly 72 and member 96, supported on pads on the outer escutcheon 20 by screws 98. Also retained by member 96 is a lever or bell crank member 100 rotationally supported on a pin 102 coupled to the outer escutcheon 20. Lever 100 carries a small roller 104 adjacent and coplanar with the cam 86, and further has an approximately horizontally extending portion 106 extending under a raised portion 108 of member 54. Accordingly, whenever the cam is rotated to the position shown in FIG. 10, roller 104 is forced to an outward position, thereby raising lever 106, carrying with it member 54 to withdraw the latch bolt.

Having now generally described the organization of the present invention, a detailed description of its operation and advantages will now be presented. FIG. 4 shows the relative positions of the cam 86, key 74 and tail piece 92 when the dead bolt is in the unlatched position and the plug and cylinder are aligned so that the key may be withdrawn from the cylinder assembly. This condition is also illustrated with respect to FIG. 6, which shows pin 80 disposed adjacent one side of the segment member 94 so that rotation of the plug in the direction indicated in FIG. 7 will immediately cause rotation of the tail piece 92. Thus, on insertion of the key and rotation of the plug as illustrated in FIG. 7, pin 80 drives the segment member 94 in rotation, as illustrated in FIG. 8, and the dead bolt assembly 36 is actuated to extend the dead bolt as a result of the rotation of the tail piece 92. It will be noted that in the rotation illustrated in FIG. 7, the cam 86 has rotated freely and not provided any additional drive to the latch mechanism. Also the key 74 may be again rotated to the initial position for withdrawal of the key, with the lost motion drive at the end of the cylinder assembly decoupling the return motion from the tail piece 92. However, for withdrawing the dead bolt, the key is rotated in the direction illustrated in FIG. 10 (e.g., the opposite direction than before) with the result that the lost motion drive rotates tail piece 92 to withdraw the dead bolt, and at the same time cam 86 rotates to the position shown in FIG. 10 to actuate the lever 100, thereby raising member 54 and withdrawing the latch bolt also. Accordingly, by the rotation of the key, both the latch bolt and the dead bolt are withdrawn, thereby simplifying entry through the previously locked door.

Certain advantages of the present invention will now become immediately obvious. The lost motion drive, in itself known, provides for the key driven actuation of the dead bolt in the conventional manner. The second substantially direct drive from the cam coupled to the end of the plug in no way interferes with the normal operation of the door latch, and yet provides a simple and positive direct drive for the latch bolt when the dead bolt is being withdrawn. Furthermore, the separation of the latch bolt drive and the dead bolt drive through the present invention allows the independent determination of the rate of retraction of the respective bolts. In particular in the preferred embodiment of the present invention the dead bolt assembly 36 is provided with a type of over-center spring drive which provides some snap action in the motion of the dead bolt. As the dead bolt is extended beyond the midway point it tends to snap to the fully extended position, and similarly when withdrawn beyond the midway point it tends to snap to the withdrawn position. The latch bolt, on the other hand, being spring loaded to the extended position, is withdrawn at a rate which may be independently determined by the relative angular position and geometry of the cam surface. The net effect, as mentioned before, is that the dead bolt may be withdrawn at a faster rate than the latch bolt. This is particularly advantageous since first withdrawal of the latch bolt may tend to pinch and jam the dead bolt, thereby inhibiting or preventing the further withdrawal of the dead bolt through the key drive. Thus in the present invention, while the dead bolt and latch bolt are being simultaneously withdrawn, the dead bolt is being withdrawn at a faster rate so as to clear the strike plate before the latch bolt clears the strike plate.

Figure 13:
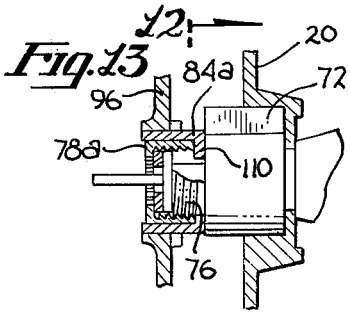
FIGS. 12 and 13 are partial cross sections of an alternate embodiment cylinder and cam assembly illustrating the coupling thereof.
Figure 12:
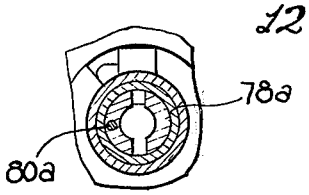

Now referring to FIGS. 12 and 13, an alternate embodiment of the present invention may be seen. In particular, in this embodiment the cylindrical member 84*a*, similar to member 84 shown with respect to the previously described embodiment, has an inward projecting finger 110 at the inner end thereof to fit under the threaded cap 78*a*, and equally importantly to fit within the slot in the plug 76. Thus while pin 80*a* retains the threaded cap 78*a* as before, the member integrally supporting the cam is captured by the threaded cap 78*a* and driven in rotation by the engagement of the finger 110 in the key slot in plug 76. In this embodiment, as well as in the foregoing embodiment, there may be a slight angular looseness between the cam and plug as a slip fit assembly is desired for ease of assembly, and absolutely rigid connection therebetween is not required. The drive, however, which is achieved is substantially rigid and positive, particularly in comparison to the lost motion drive also coupled to the plug.

There has been described herein a lock cylinder with dual driver which allows the independent drive of the dead bolt and the latch bolt for the simultaneous withdrawal of both. Two specific embodiments have been disclosed and described utilizing a substantially direct drive and at the same time a lost motion drive from a single plug of a cylinder lock assembly, which provides very simple and positive independent drives for simultaneous withdrawal of the latch bolt and dead bolt. While preferred embodiments of the present invention have been disclosed and described in detail herein, it will be immediately obvious to those of reasonable skill in the art that various changes in form and detail may be made therein without departing from the spirit and scope of the invention.

I claim:

1. In a door latch and lock assembly having a dead bolt, apparatus for withdrawing both the latch bolt and the dead bolt upon rotation of the key comprising:

a cylinder housing containing a plurality of pins;

a plug within said cylinder housing having a front portion and a rear portion and containing a plurality of tumblers in cooperative disposition with respect to said pins, said plug having a key receiving slot on the front face thereof in cooperative disposition with respect to said tumblers;

a first drive means coupled to the rear portion of said plug, said first drive means being a lost motion drive for driving a dead bolt between latched and unlatched positions; and a second drive means substantially rigidly secured to the rear portion of said plug for driving a latch bolt between latched and unlatched positions.

2. The apparatus of claim 1 wherein said second drive means is a cam means.

3. The apparatus of claim 1 further comprised of a cap coupled to said rear portion of said plug, said second drive means being radially supported by said cap.

4. The apparatus of claim 3 wherein said second drive means is retained between said cylinder housing and said cap.

5. The apparatus of claim 1 wherein said second drive means is driven in rotation by direct engagement with said plug.

6. The apparatus of claim 1 further comprised of a pin retaining said cap in fixed disposition with respect to said plug and wherein said second drive means is driven in rotation by said pin.

7. In a door latch and lock assembly having a dead bolt, apparatus for withdrawing both the latch bolt and the dead bolt upon rotation of the key comprising:

a cylinder housing containing a plurality of pins;

a plug within said cylinder housing having a front portion and a rear portion and containing a plurality of tumblers in cooperative disposition with respect to said pins, said plug having a key receiving slot on the front face thereof in cooperative disposition with respect to said tumblers;

a cap threaded onto the rear portion of said plug;

a pin extending into cap for retaining said cap in fixed disposition with respect thereto;

a tail piece member having a segment member retained under said cap and driven in rotation by said pin to provide a lost motion drive for the dead bolt; and a second drive means coupled to the rear portion of said plug for driving a latch bolt between latched and unlatched positions.

8. The apparatus of claim 7 wherein said second drive means is coupled to said rear portion of said plug with a lost motion which is at least substantially less than the lost motion of said first drive means.

9. The apparatus of claim 8 wherein said second drive means is substantially rigidly secured to said rear portion of said drive piece.

10. The apparatus of claim 7 wherein said second drive means is a cam means.

11. The apparatus of claim 7 wherein said second drive means is radially supported by said cap.

12. The apparatus of claim 11 wherein said second drive means is retained between said cylinder housing and said cap.

13. The apparatus of claim 7 wherein said second drive means is driven in rotation by direct engagement with said plug.

14. The apparatus of claim 7 wherein said second drive means is driven in rotation by said pin.

* * * * *